United States Patent [19]

Williams

[11] 3,936,384

[45] Feb. 3, 1976

[54] RELIGIOUS SOAP

[76] Inventor: Yancey Williams, G.P.O. Box 1373, New York, N.Y. 10038

[22] Filed: Jan. 14, 1975

[21] Appl. No.: 540,992

[52] U.S. Cl. ..... 252/90; 252/134; 252/174; D73/1 A

[51] Int. Cl.[2] ..... C11D 17/00

[58] Field of Search ..... 252/92, 90, 134, 174; D73/1 A

[56] References Cited

UNITED STATES PATENTS

| | | | |
|---|---|---|---|
| 6,624 | /1875 | Strunz | 252/92 |
| 2,423,435 | 7/1947 | Block | 252/134 |
| D192,131 | 1/1962 | Weiss | D73/1 A |

*Primary Examiner*—William E. Schulz

[57] ABSTRACT

A soap bar which is embossed with a religious design on one side and a prayer on the other side.

3 Claims, 3 Drawing Figures

RELIGIOUS SOAP

SUMMARY OF THE INVENTION

My invention relates to a soap bar which is embossed with religious markings and particularly a bar of soap embossed on one face with a religious design and on another face with the words of a prayer.

BRIEF DESCRIPTION OF THE DRAWING

The objects and features of the invention may be understood with reference to the following detailed description of an illustrative embodiment of the invention, taken together with the accompanying drawings in which.

DESCRIPTION OF THE PREFERRED EMBODIMENT

Figure 1:
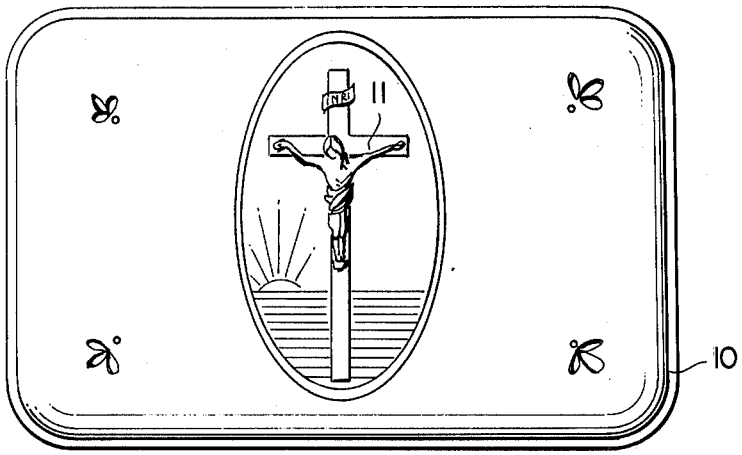
FIG. 1 is a plan view of the top face of a bar of soap.
Figure 2:
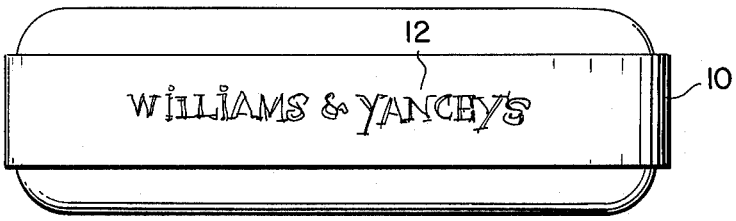
FIG. 2 is a side view of the bar of soap.
Figure 3:
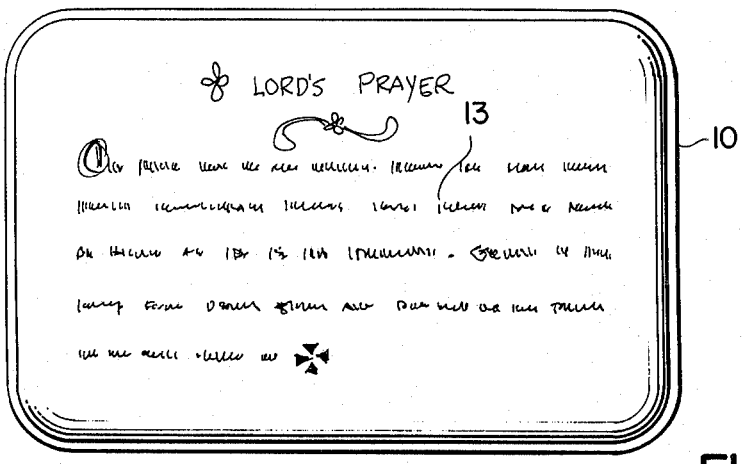
FIG. 3 is a plan view of the bottom face of the bar of soap.

Turning now descriptively to the drawings, in which similar reference characters denote similar elements throughout the several views, FIGS. 1–3 illustrate the bar of soap which is embossed on the top face with the markings 11 of a crucifixion scene, and on the opposing face with the markings 13 of a prayer. A side face may be embossed with markings 12 of the designer or producer of the soap bar 10.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the U.S. is:

1. A bar of soap which is embossed with religious markings.

2. The combination as recited in claim 1 in which a crucifixion scene is embossed on one face of the bar.

3. The combination as recited in claim 2 in which the words of a prayer are embossed on an opposing face of the bar.

* * * * *